US006286680B1

(12) United States Patent
Hofrichter

(10) Patent No.: US 6,286,680 B1
(45) Date of Patent: Sep. 11, 2001

(54) PACK OF BAGS MADE OF A THERMOPLASTIC FOIL AND METHOD FOR PRODUCING THE PACK OF BAGS

(76) Inventor: Karl-Heinz Hofrichter, Rua Sao Nazario 282, Jardin Santo Amaro, 04741-150 San Paulo (BR)

( * ) Notice: Subject to any disclaimer, the term of this patent is extended or adjusted under 35 U.S.C. 154(b) by 0 days.

(21) Appl. No.: 09/252,766

(22) Filed: Feb. 19, 1999

(30) Foreign Application Priority Data

Jul. 18, 1998 (DE) ..... 298 12 818
Jul. 18, 1998 (DE) ..... 298 12 819

(51) Int. Cl.[7] ..... B65D 33/00
(52) U.S. Cl. ..... 206/554; 383/209; 493/228
(58) Field of Search ..... 206/554; 383/9, 383/37, 207, 35, 209; 493/186, 194, 195, 198, 204, 228, 238

(56) References Cited

U.S. PATENT DOCUMENTS 4,595,389 * 6/1986 Lehmacher ..... 383/9
4,781,474 * 11/1988 Sengewald ..... 206/554
4,854,451 * 8/1989 Jensen ..... 206/554
4,890,736 * 1/1990 Greyvenstein ..... 383/37
5,226,858 * 7/1993 Snowdon ..... 206/554
5,348,399 * 9/1994 DeMatteis ..... 206/554
5,469,969 11/1995 Huang .
5,655,682 8/1997 Hoffrichter .
5,662,225 * 9/1997 DeMatteis ..... 206/554
5,924,573 * 7/1999 Piraneo et al. ..... 206/554

FOREIGN PATENT DOCUMENTS 94 08 149.2 5/1994 (DE) .
2 160 173 12/1985 (GB) .

* cited by examiner

*Primary Examiner*—Luan K. Bui
(74) *Attorney, Agent, or Firm*—Pauley Peterson Kinne & Fejer

(57) ABSTRACT

A pack of bags and a method for producing the bags made of thermoplastic foil, wherein the bags are interlocked into a pack at least in an area of an edge strip and have a perforated tear-off line formed below the interlocked area for separating the bags from the interlocked edge strip. A bag bottom is formed by a weld seam in the area opposite the edge strip wherein, for the purpose of reducing the bag width, each bag of a pack is folded around folding edges extending in a longitudinal extension of the bag and in the folded position is interlocked in an edge area with the pack. The tear line of the folded bags stamped into the pack of bags is designed in a form of sickle-shaped incisions, wherein the sickle-shaped incisions extend as far as the longitudinal sides of the pack of bags and are cut through the bags, so that the folded bags are separated at their outer lateral edges from the interlocked edge strip and connecting strips are formed between the sickle-shaped incisions. The bags are connected with the edge strip in such a way that the connecting strips tear off when the bags are pulled off. This invention also relates to a method for producing the bags.

18 Claims, 4 Drawing Sheets

PACK OF BAGS MADE OF A THERMOPLASTIC FOIL AND METHOD FOR PRODUCING THE PACK OF BAGS

BACKGROUND OF THE INVENTION

1. Field of the Invention

This invention relates to a pack of bags made of thermoplastic foil, wherein the bags are interlocked into a pack at least area-wise in an area of an edge strip and have a perforated tear-off line formed below the interlocked area for separating the bags from the interlocked edge strip and a bag bottom is formed by a weld seam in an area opposite the edge strip.

This invention further relates to a method for producing a pack of bags from bags made of thermoplastic material, wherein the bags are made from a tubular plastic film laid flat by making a bottom weld seam transversely with respect to the longitudinal extension and the feed direction of the tubular foil, and the bags are cut parallel with and next to the bottom weld seam, and the bags are thereafter stacked into a pack and interlocked in an edge area located opposite the bottom weld seam and wherein, after the termination of the deposition of further bags, a perforated tear line for tearing the bags individually off the pack is stamped into an edge area of each pack near the interlocked edge area.

2. Description of Prior Art

Interlocked packs of plastic bags are known, they are used as a stock for the individual removal of a bag when it is needed, which is torn off the interlocked pack along a perforated tear line. In addition, packs of bags are often offered in redistribution packages or in dispenser boxes for individual removal. Reference is made only by way of example to German Patent Publication DE 94 08 149.2 U1 or U.S. Pat. No. 5,655,682.

SUMMARY OF THE INVENTION

This invention is based on one object of providing a pack of bags made of thermoplastic material, as well as a method for doing this, which pack can be made of a small size, for example considerably smaller than the individual bag, and which furthermore allows the clean tearing off of individual bags from the pack. The bag is also intended to have sufficient stability and sturdiness not only because of the selection of the plastic foil, but also with respect to the weld stability of the bottom weld.

One object on which this invention is based is attained in connection with packs of bags of the type in accordance with the species by reducing the bag width. Each bag of a pack is folded around folding edges extending in a longitudinal extension of the bag and in the folded position is interlocked in the edge area with the pack. The tear line of the folded bags stamped into the pack of bags is designed in the form of sickle-shaped incisions, wherein the sickle-shaped incisions extend as far as the longitudinal sides of the pack of bags. The sickle-shaped incisions are cut through the longitudinal sides of the bags, so that the folded bags are separated at outer lateral edges from the interlocked edge strip and connecting strips are formed between the sickle-shaped incisions, by which the bags are connected with the edge strip in such a way that the connecting strips tear off when the bags are pulled off.

In accordance with this invention the method for producing packs of bags made of a thermoplastic material is distinguished because prior to or following a welding of the bottom weld seam the tubular foil is folded in around at least one folding edge extending in the longitudinal direction of the tubular foil and of the bag to be produced. A tear line, including sickle-shaped, bent or half-wave-shaped incisions with narrow connecting strips remaining between them, is stamped into the pack of bags, wherein the incisions are also made on the lateral edges of the bags, or respectively the pack.

In order to reduce large size bags to smaller sizes, the individual bags are folded prior to being interlocked around at least one folding edge extending in the longitudinal direction of the bag, for example transversely in relation to the bottom weld, wherein multiple folding is preferred. In this case it is possible to perform a simple V fold, for example the reduction of the width of the bag by one half, or a so-called M fold, for example three folding edges and a reduction of the bag width to a quarter, or also around four fold edges, depending on the width of the bag.

In order to reduce the length of the bag it is proposed to fold over the pack of bags as a whole once or twice transversely to the longitudinal extension of the bags. In this case an S-shaped or Z-shaped fold-over is possible the same as a C-shaped fold-over toward the inside, or also a one-and-a-half or two-and-a-half fold over. It is possible in this way to offer large size bags in small size packs, and then to offer these small size packs in appropriate dispenser boxes or in enclosed or redistribution packages for the individual removal of the bags.

It is important for removal of the individual bag from the pack, for the bag edge to not tear near the provided perforated tear line. Thus, in accordance with this invention the tear line is designed in a shape of individual sickle-like incisions, wherein the sickle-like incisions are also made along the lateral edges of the folded bags, or respectively of the pack of bags in particular, so that the bag to be separated from the pack is previously cut off the edge strip in this area. Then the bags interlocked in the pack are only connected with the edge area of the pack at a few connecting strips, wherein the connecting strips are symmetrically arranged with respect to the longitudinal extension of the pack of bags and in this way makes possible even tearing off of the bag, and also makes possible individual folds of the folded bag from the edge strip, wherein tearing of the bag edge is prevented.

The sickle-shaped incisions form perforations, which form a garland-shaped tear line with long incisions, and are important for the invention, wherein sickle-shaped incisions also include wave-shaped incisions of sinusoidal-shaped waves, or arc-shaped incisions or very long-extending incisions.

Advantageous further developments of this invention are discussed in this specification and in the characterizing features of the dependent claims.

In place of the perforated tear lines customary up to now, wherein a multitude of short incisions or holes are interspersed with intermediate strips of approximately the same length, because of which tearing must be performed forcefully along the entire tear line, in accordance with this invention only very few connecting strips remain, wherein a stress on the bag in the area of the bag opening takes place only at these few locations and therefore tearing proceeds very rapidly and cleanly, without tearing into the bag in the area of the bag edge. Also, a particularly advantageous shape of the connecting strips remains because of the sickle-shaped incisions, which makes tearing off easier without tears occurring in the bag edge. The sickle-shaped incisions are arranged in a garland-like manner along the tear line, and their largest bulges are directed toward the bottom of the bags. At least two sickle-shaped incisions with a connecting strip between them, but preferably at least three sickle-shaped incisions or four sickle-shaped incisions with two, or respectively three, connecting strips between them remaining, are provided as a tear line on the pack of bags.

Spacings of 2 to 3 cm between the connecting strips of the tear line are preferred, wherein the connecting strips have a width of approximately 1 to 3 mm at the tear-off location.

The design of bags with tear lines, which are embodied as perforations in the shape of stamped half-waves, arcs or sickles, allows easy and clean tearing off of the bags from the pack, requiring little user strength and without tearing of the bag foil. Preferably a tear line of at least three incisions and two connecting strips remaining between the incisions is stamped into the pack.

The bottom weld seam in the bags interlocked into packs can be made either prior to or after the bags are folded. If the bottom weld seam of the bags is made over the entire width of the unfolded bag during production, it is a simple weld seam.

To increase the sturdiness of the bottom weld seam of the bag, the bottom weld seam of each individual bag is preferably produced after it is folded over the fold edges extending in the longitudinal direction of the bag, so that it extends over the width of the folded bag. In this way, with a bag folded in an M-shape, a so-called M-shaped bottom weld seam is formed, which lends increased sturdiness to the bottom of the bag.

It can be practical for the use of the packs of bags, for example in dispenser boxes, to additionally stamp a slit in at least one location of the edge strip of the pack of bags in which the bags are interlocked, or at two locations or along a line-shaped interlocking area, into which a fixation means for fixing the pack of bags in place at a location can be inserted.

Advantageous further embodiments of the invention will be explained in what follows by means of exemplary embodiments represented in the drawings.

DESCRIPTION OF PREFERRED EMBODIMENTS

Figure 1:
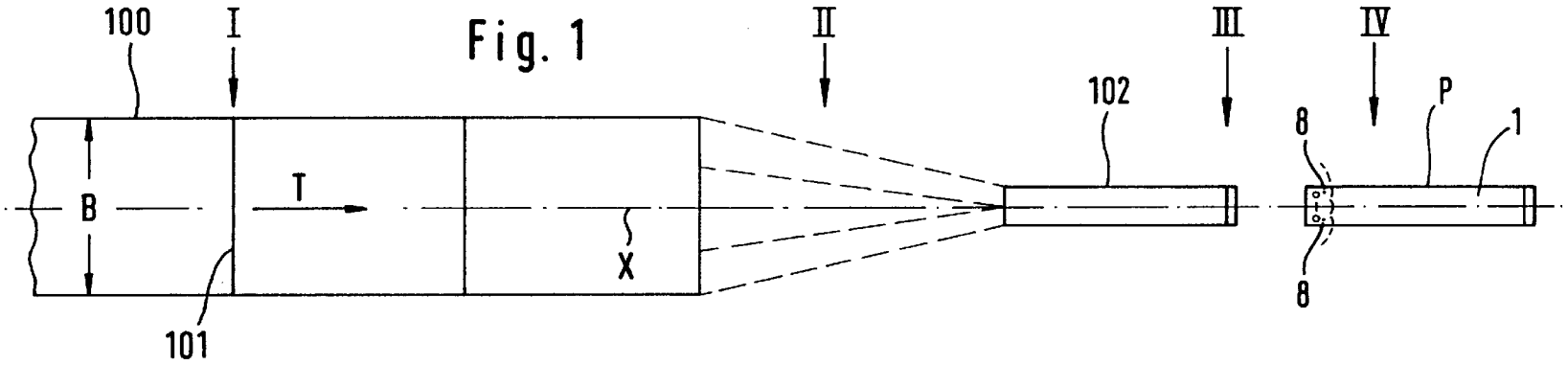
FIG. 1 is a diagrammatic view of a production of a pack of bags with folded bags in a schematic manner.

The production of packs of bags made of a thermoplastic foil material is represented schematically in FIG. 1. The basis for a simple bag, for example, is a tubular foil 100 made of a thermoplastic material, for example polyethylene, which is moved over a welding station I in a feed direction T. A weld seam 101 is welded by means of a welding bar in cycles in accordance with the desired length of the bag across the width B of the tubular foil 100, which corresponds to the width of the bag and constitutes the subsequent bottom weld seam of the bag. In the area of the folding station II, the tubular foil 100, which is welded in sections and transported on in the feed direction T, is folded in a direction of the longitudinal extension of the bag and the tubular foil around the folding edges 120, see FIG. 2. With three folding edges with four folded parts the tubular foil 100, and therefore the bag, are reduced to a quarter of the width B. In the represented example, the tubular foil 100, and therefore the bag, are folded into an M-shape 102, see also FIG. 3. The folded tubular foil 102 is passed on to the cutting station III. Here, the bags are cut to size parallel with the weld seam 101 and close to the weld seam 101, and the individual bags 1 are conveyed onward and collected in a stacking and interlocking station IV. For example, two stacking bars 8 are provided in the station IV, on which the cut-to-size individual bags 1 are stuck in the area of their opening edge, opposite the bottom weld seam 101, and are collected into a pack P. Each one of the bags 1 placed on the already present stack is additionally interlocked in the area of the stacking bars 8, for example welded together with the bags underneath it. Preferably two interlocking locations 105 are provided, and the interlocking station is accordingly equipped with two welding punches. After collecting a desired number of bags 1 into the desired pack of bags P, the tear line 107 is stamped into the pack of bags and, if desired, the slit 108 is additionally stamped into the area of the edge strip R, also see FIG. 4. Thus, the station IV is equipped wit stamping tools in the shape of the desired tear line. The pack of bags P produced in this manner is then lifted off the stacking bars 8 and is forwarded for further fabrication and packaging.

Figure 3:
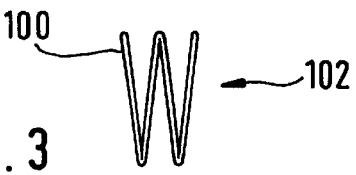
Figure 4:
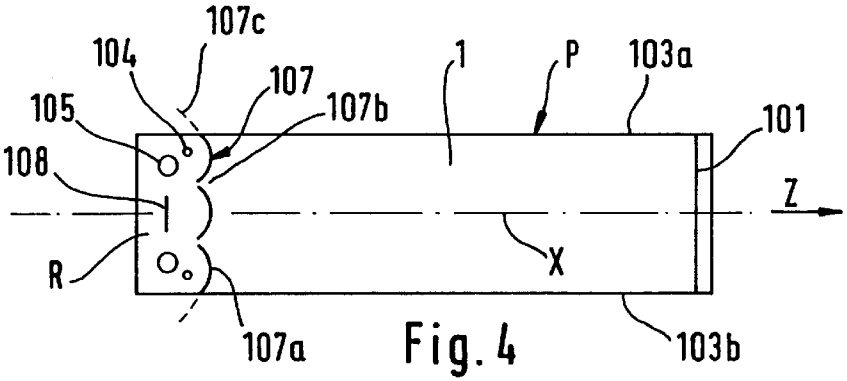
FIG. 4 is a top view of a pack of bags.
Figure 5:
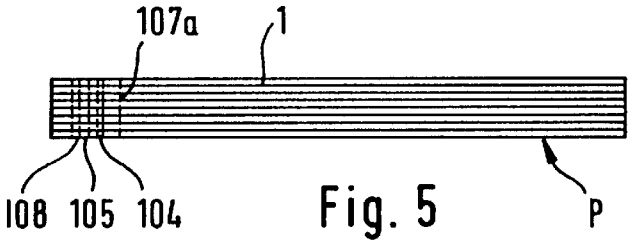
FIG. 5 is a side view of the pack of bags shown in FIG. 4.

The pack of bags P produced in the stacking and interlocking station IV in accordance with FIG. 1, is again represented in detail in FIG. 4. The stacking bars 8 leave small holes 104 behind in the area of the edge strip R of the pack of bags P, wherein the interlocking areas 105 are arranged next to the small holes 104. It is also possible to interlock the bag 1, for example between the two holes 104 of the stacking bars and, if desired, to stamp an additional slit above it, for example toward the edge. In the example represented, the bags 1 are interlocked, folded in an M-shape, see FIG. 3, in the pack of bags P in accordance with FIG. 4. The tear line 107 for separating the individual folded bags 1 from the pack of bags P is formed between the edge strip R and the bag 1. The tear line 107 comprises sickle-shaped incisions 107*a*, three such incisions for a pack in the represented example, as well as narrow strips 107*b* remaining between the sickle-shaped incisions. The sickle-shaped incisions 107*a* extend through the lateral edges 107*a,b* of the pack, or respectively of the folded bags, see FIG. 5, so that on the edge strip R the individual bags 1 are merely connected by the narrow strips 107*b* and can be easily torn off when pulled off in the direction of the arrow Z, see FIG. 4, without tears being created in the area of the bag opening which is then created. The reason for this is that, viewed over the width of the bag, the largest area is cut by the incisions 107*b*, and only the smallest portion of the width in the area of the strips 107*b* need still be cut.

The strips 107*b* are in particular arranged symmetrically with respect to the longitudinal axis X of the bags, so that with a central action on the bag in the Z direction its even tearing off and separation from the edge strip R can occur. When stamping the incisions 107 in the station IV, the stamping knives are arranged in such a way, that a lateral overlap takes place, see the dashed line 107*c* indicated in FIG. 4, so that the lateral edges of the folded bags are already severed.

Figure 6:
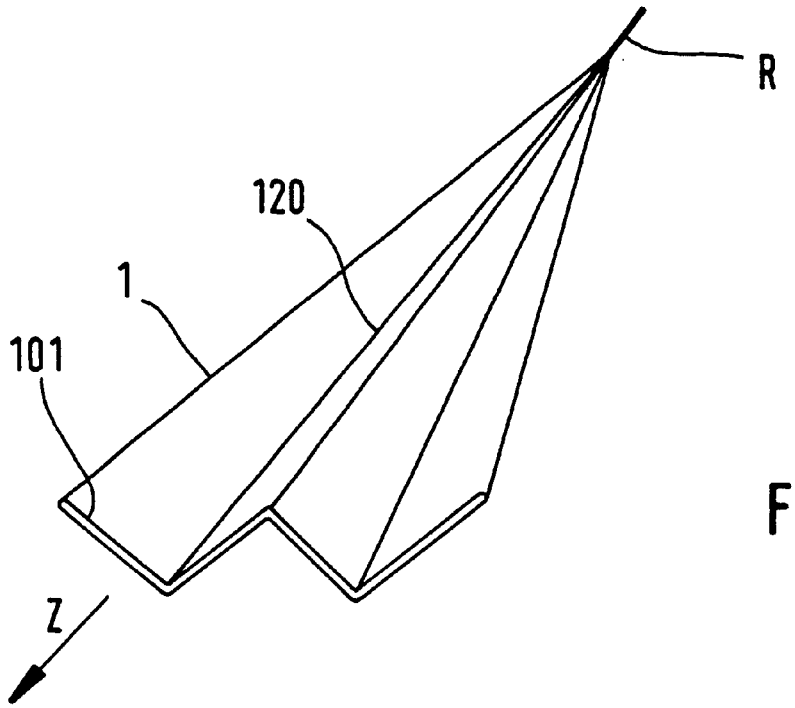
FIG. 6 is a schematic perspective representation of a bag with an interlocking edge.
Figure 7:
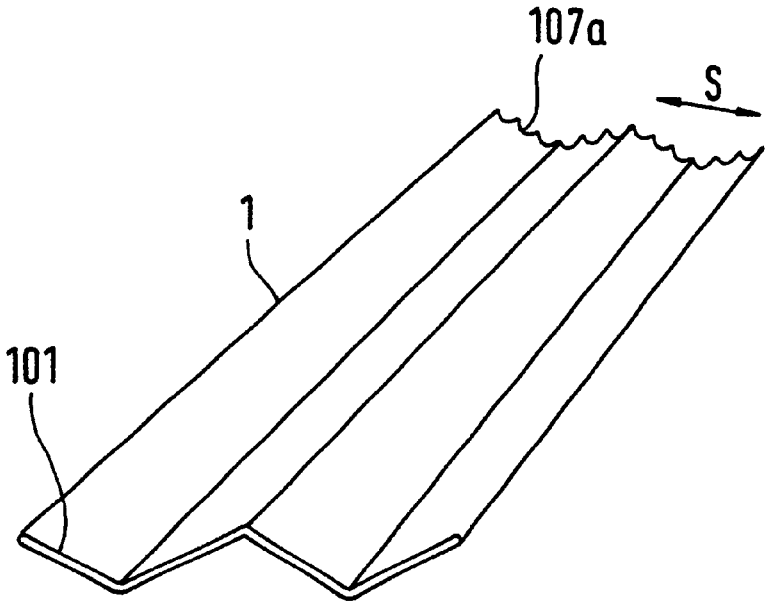
FIG. 7 shows a bag torn off the interlocking edge shown in FIG. 6.

This process is again schematically represented in FIG. 6 and in FIG. 7. From FIG. 6 it can be seen how the folded bag 1, which is folded in an M-shape around the longitudinal edges 120, is pulled off the edge strip R in the Z direction in order to then obtain the torn-off bag 1 in accordance with FIG. 7 with the opening edge distinguished by the sickle-shaped incisions 107*a*. By pulling the two foil sides of the bag apart in the direction of the arrow S, it is then opened in the area of the tear-off edge for filling.

Figure 2:
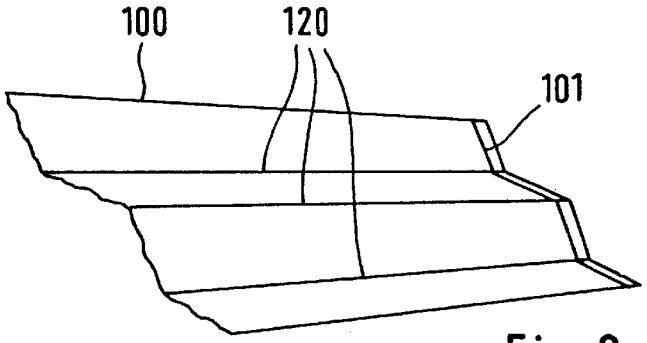
FIGS. 2 and 3 show details of the folding of the bags, respectively in a plan view and in cross section.
Figure 8:
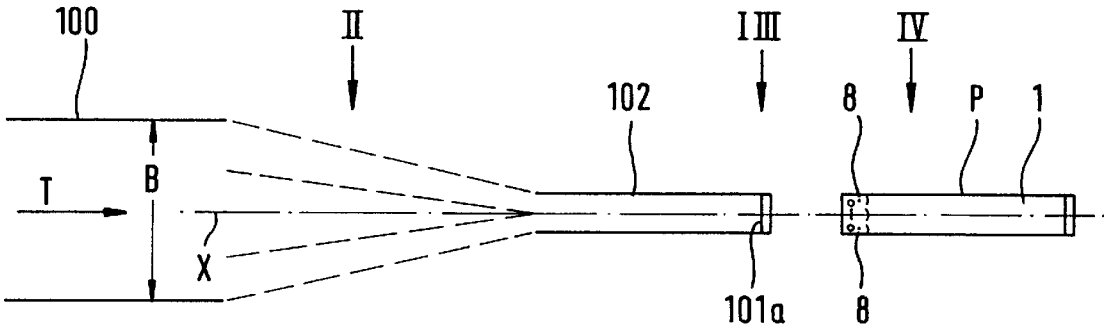
FIG. 8 is a schematic representation for producing a further embodiment of a folded bag.
Figure 9:
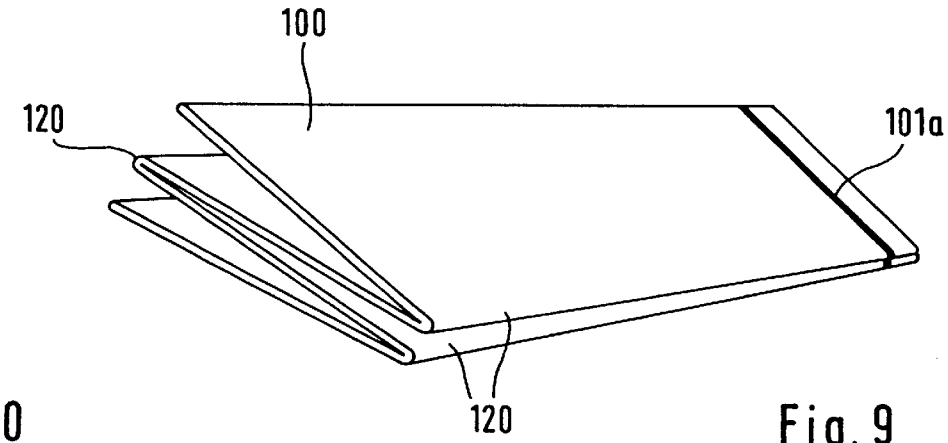
FIG. 9 shows details of the folded bag in accordance with FIG. 8 with an M-shaped bottom weld seam.
Figure 10:
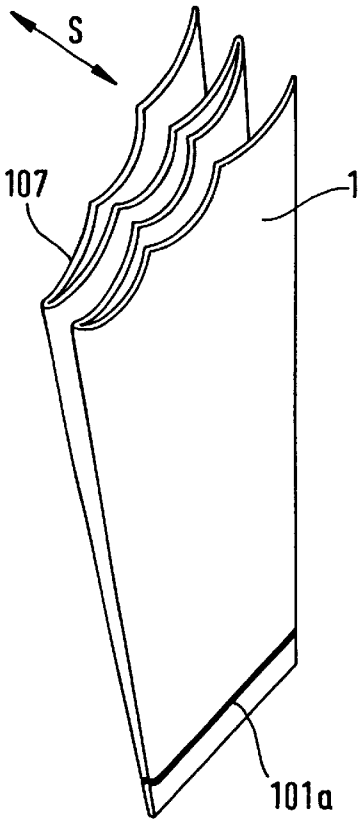
FIG. 10 represents a bag torn off a pack of bags, which is produced in accordance with FIG. 8.

A further variant of the production of a pack of bags in accordance with this invention is represented in FIG. 8. In this case a tubular foil 100, which is laid flat and therefore corresponds to the width B of a bag to be produced, is initially moved in the transport direction T to a folding station II, in which the tubular foil, laid flat, is again folded in an M shape, as represented in FIGS. 2 and 3. Thereafter the tubular foil 100, folded in this manner, is conducted to a combined welding and cutting station I, III, wherein a weld seam 101*a* is made transversely over the folded tubular foil to form a bottom weld seam, see FIG. 9, because of which the bottom area of the bag achieves a considerable increase in sturdiness. Simultaneously with or following the production of the weld seam 101*a* over the folded-in tubular foil and therefore the folded-in bag, the cutting to size of the bag 1 takes place by severing it parallel with and next to the bottom weld seam and then stacking it in the stacking and interlocking station IV which follows. The further processing of the bags in the pack of bags for producing the pack takes place as explained in connection with FIGS. 1, 4 and 5. After tearing it off the pack of bags which was produced, a bag as represented in FIG. 10 results, which has an M-shaped bottom weld seam 101*a* and a wavy tear edge 107 in accordance with the sickle-shaped incisions of the tear line. After the bag is torn off the pack, the bag can be opened by pulling the foils apart in the direction of the arrow S.

The pack of bags produced in accordance with FIG. 1 or in accordance with FIG. 8 can be reduced to a further smaller size by being folded transversely to the longitudinal extension of the pack, either simply or doubly in a V-shape or a Z-shape, in order to be then inserted into a redistribution package or a dispenser. Then the redistribution package or the dispenser can have a recess for grasping the bags, which makes it possible to separate the bags from the pack by tearing the bags off the interlocked edge strip and to take the bags out.

Figure 11:
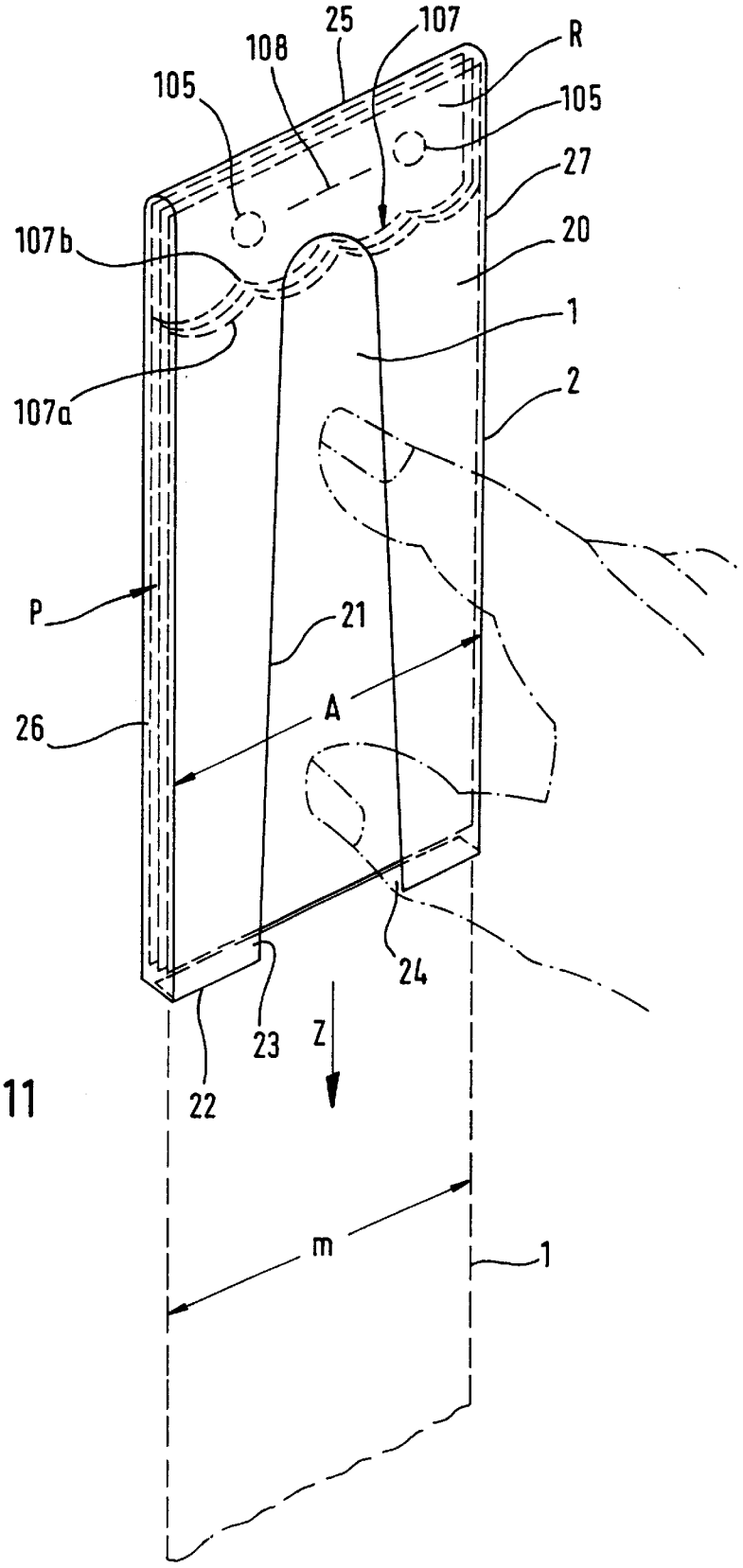
FIG. 11 is a perspective view of a dispenser with a pack of bags inserted.

A dispenser 2, which has a flat cuboid shape with a top 20, narrow longitudinal sides 26, 27, a top edge 25 and an oppositely located lower edge 22, as well as a bottom adjoining the lower edge 22, is shown in FIG. 11 in a perspective schematic view. A pack of bags P with bags 1 is inserted into the dispenser 2, wherein the bags are interlocked with each other in two areas 105 in an edge area R extending parallel with the top edge of the dispenser. Preferably a slit 108 extends through the center of the edge strip R and is formed by stamping. The individual bags 1 are connected with the edge strip along a tear line 107, wherein the tear line comprises four incisions 107*a*, stamped out in a sickle-shape or arc-shape and aligned in a garland shape, as well as narrow connecting strips 107*b* located between the incisions 107*a*. In the center of the top 20 of the dispenser 2, the grasping recess 21 is formed, starting from an area where the edge strip is marked by the tear line 107. The grasping recess 21 extends down to the bottom edge 22 of the dispenser and has, for example, a slightly conical widened shape toward the outlet. The carrying recess is so large that it can be easily penetrated by a finger, so that a bag 1 can be severed from the edge strip R at the tear line 107 by pressure on the bag and a simultaneous pulling off movement in a direction of the arrow Z, for example in the direction toward the lower edge, and pulled out. For example, the grasping recess 21 takes up a third of the width A of the dispenser approximately in the area of the lower edge.

In the area of the lower edge 22, the grasping recess 21 is widened to a width m in the direction of the two narrow longitudinal sides 26, 27 by means of gaps 23, 24, which are formed on the lower edge and extend adjoining the lower edge formed by the top. A pull-out slit of a length m, which approximately corresponds to the width of the folded bags 1 arranged in the pack of bags, is formed in this way on the lower edge 22 of the dispenser adjoining the grasping recess 21. The grasping recess 21 and the pull-out slit constituted by the slits 23, 24 extend on successive sides of the dispenser. The grasping recess 21 provided on the top 20 allows grasping of the topmost bag 1 for pulling the bag 1 off from the edge strip R, while the subsequent pull-out slit at the lower edge makes it possible to pull the grasped bag 1 easily out of the dispenser 2 in the direction of the arrow Z over its entire width through the correspondingly wide pull-out slit, as represented in dashed lines.

This invention allows the production of packs of bags of small-size, which contain large-sized bags, as well as correspondingly small-sized dispensers. Particularly easy tearing-off, namely controlled and orderly tearing-off of the bags 1 from the pack along the tear line, is made possible by designing the tear line in accordance with this invention, without the bags tearing in the area of the bag opening. In addition, the sturdiness of the bags can be provided by the appropriate design of the bottom weld seam of the folded bags in the form of an M weld seam.

Furthermore, the orderly removal of individual bags from the pack of bags can take place and can be assured by an appropriate design of a dispenser with a grasping recess and an additional pull-out slit.

What is claimed is:

1. In a pack of bags made of a thermoplastic foil, wherein the bags are interlocked into a pack at least in an area of an edge strip and have a perforated tear line formed below an interlocked area for separating the bags from the interlocked edge strip and a bag bottom is formed by a weld seam in an area opposite the edge strip, the improvement comprising: for reducing a bag width (B) each bag of the pack folded around a plurality of folding edges (120) extending in a longitudinal extension (X) of the bag and in a folded position interlocked in the edge strip (R) with the pack, the tear line (107) of the folded bags stamped into the pack of bags formed as a plurality of sickle-shaped incisions (107*a*) extending as far as longitudinal sides of the pack of bags and cut through the longitudinal sides of the bags, the folded bags (1) being separated at a plurality of outer lateral edges (103*a,b*) from the interlocked edge strip (R), a plurality of connecting strips (107*b*) formed between the sickle-shaped incisions so that the bags are connected with the edge strip (R) in such a way that the connecting strips (107*b*) tear off when the bags are pulled away and each of the bags (1) folded in to a size of one quarter of the bag width (B) in an M shape, when viewed in a cross section.

2. In the pack of bags in accordance with claim 1, wherein the sickle-shaped incisions (107*a*) are formed in the packs of bags in a shape of garlands and with a plurality of bulges directed toward a bottom of each of the bags.

3. In the pack of bags in accordance with claim 2, wherein at least two of the sickle-shaped incisions (107*a*) with a connecting strip (107*b*) between them form a tear line (107) for the pack of bags.

4. In the pack of bags in accordance with claim 3, wherein before unfolded the bottom weld seam (101) of each bag is designed extending entirely over the bag width (B) and folded around folding edges (120) running in the longitudinal extension of the bag.

5. In the pack of bags in accordance with claim 3, wherein following folding of the bag around the folding edges (120) running in the longitudinal extension of the bag, the bottom weld seam (101*a*) of each bag is formed extending over the bag width (B) of the folded bag.

6. In the pack of bags in accordance with claim 5, wherein the bags are interlocked at least at one of the areas (105) extending symmetrically with respect to the longitudinal extension of the bags.

7. In the pack of bags in accordance with claims 6, wherein a slit (108), extending completely through the edge strip (R) of the pack, is stamped between the interlocked area (105).

8. In the pack of bags in accordance with claim 7, wherein the bag is folded at least once parallel with the tear line and transversely with respect to the longitudinal extension of the bags for reducing a size of the bags.

9. In the pack of bags in accordance with claim 1, wherein the sickle-shaped incisions (107*a*) are formed in the packs of bags in a shape of garlands and with a plurality of bulges directed toward a bottom of each of the bags.

10. In the pack of bags in accordance with claim 1, wherein at least two of the sickle-shaped incisions (107*a*) with a connecting strip (107*b*) between them form a tear line (107) for the pack of bags.

11. In the pack of bags in accordance with claim 1, wherein when folded the bottom weld seam (101) of each bag extends entirely over the bag width (B) and folded around folding edges (120) running in the longitudinal extension of the bag.

12. In the pack of bags in accordance with claim 1, wherein following folding of the bag around the folding edges (120) running in the longitudinal extension of the bag, the bottom weld seam (101*a*) of each bag is formed extending over the bag width (B) of the folded bag.

13. In the pack of bags in accordance with claim 1, wherein the bags are interlocked at least at one of the areas (105) extending symmetrically with respect to the longitudinal extension of the bags.

14. In the pack of bags in accordance with claim 1, wherein a slit (108), extending completely through the edge strip (R) of the pack, is stamped between the interlocked area (105).

15. In the pack of bags in accordance with claim 1, wherein the bag is folded at least once parallel with the tear line and transversely with respect to the longitudinal extension of the bags for reducing a size of the bags.

16. In a method for producing a pack of bags from a plurality of bags of thermoplastic material wherein the bags are made from a tubular plastic foil laid flat by making a bottom weld seam transversely with respect to a longitudinal extension and a feed direction of the tubular plastic foil, and cutting the bags to a size parallel with and next to the bottom weld seam, and are then stacked into a pack and interlocked in an edge area located opposite the bottom weld seam and wherein, after terminating further deposition of the bags, a perforated tear line for tearing the bags individually off the pack is stamped into the edge area of each pack near the interlocked edge area, the improvement comprising:

a. one of before and after welding the bottom weld seam (101*a*) folding the tubular foil around at least one folding edge (120) extending in a longitudinal direction of the tubular foil and of the bag to be produced, b. stamping into the pack of bags a tear line, having at least one of a sickle-shape, a bent-shape and a half-wave-shape of incisions with narrow connecting strips remaining between the incisions, wherein the incisions are formed on the lateral edges of one of the bags and the pack of bags, and c. folding the tubular foil in a shape of an M to a quarter of a width of the tubular foil.

17. In the method in accordance with claim 16, wherein the bottom weld seam is formed over the tubular foil folded in the shape of the M.

18. In the method in accordance with claim 16, wherein a tear line having at least three incisions and two connecting strips remaining between the incisions is stamped into the pack of bags so that largest bulge is directed toward a bag bottom.

* * * * *